US005572872A

United States Patent [19]

Hlavacek

[11] Patent Number: 5,572,872

[45] Date of Patent: Nov. 12, 1996

[54] LIQUID COOLING, STORING AND DISPENSING DEVICE

[76] Inventor: Robert A. Hlavacek, 42 Visconti Dr., Naugatuck, Conn. 06770

[21] Appl. No.: 290,494

[22] Filed: Aug. 15, 1994

[51] Int. Cl.[6] ..... F25B 21/02

[52] U.S. Cl. ..... 62/3.6; 62/3.3; 62/3.64; 62/3.7

[58] Field of Search ..... 62/3.3, 3.6, 3.64, 62/3.7

[56] References Cited

U.S. PATENT DOCUMENTS

| | | | |
|---|---|---|---|
| 2,947,150 | 8/1960 | Roeder, Jr. | 62/3.6 |
| 3,100,969 | 8/1963 | Elfving | 62/3.6 |
| 3,438,214 | 4/1969 | Schmittle | 62/3.7 |
| 3,823,567 | 7/1974 | Corini | 62/3 |
| 4,320,626 | 3/1982 | Donnelly | 62/3 |
| 5,301,508 | 4/1994 | Kahl et al. | 62/3.62 |

*Primary Examiner*—Henry A. Bennet
*Assistant Examiner*—Siddharth Ohri

[57] ABSTRACT

This invention relates to a device used for cooling, or keeping cool, an individual liquid container. Although a cooler for milk or coffee creamer will be described in detail, the device can be used for refrigerating any liquid, and the interior of the device may serve as the container. The device is composed of a container, which is normally closed but has an opening feature for loading the device or dispensing a liquid, and a cooling unit. An outer container surface is thermally insulated from an inner container surface and a cooling component portion of a cooling unit is in thermal contact with the inner container surface. In one version of the device the cooling unit is a thermoelectric module, and the insulation is of the vacuum bottle type. In another version of the invention the outer container comprises both the insulation and the outer container surface as a unitary structure. Specially constructed heat dissipating fins remove heat from the heat rejecting portion of the refrigerating unit.

14 Claims, 9 Drawing Sheets

LIQUID COOLING, STORING AND DISPENSING DEVICE

BACKGROUND—FIELD OF INVENTION

This invention relates to refrigerating apparatus for a liquid container such as a milk carton or bottle of a beverage. More specifically it relates to an apparatus for cooling and keeping cool an individual container or package of a drink or liquid coffee creamer, which is not portable, but is to be used in the home, office, or workplace. The device has a feature for dispensing liquid without removing the liquid package from the device. The refrigeration may be supplied by thermoelectric, absorption, compression-expansion, or other methods.

An appropriate beverage or liquid dairy product used with the device is normally refrigerated to either preserve the product from spoiling or because the beverage is preferably consumed cold. It is normally cooled and stored in a refrigerator. However, a refrigerator is not always available close to where the liquid is used due to high cost or space limitations. Considering specifically a liquid creamer for coffee, many coffee makers exist far away from a refrigerator. In this case, a non-dairy powered creamer is frequently used, which does not require refrigeration. A great many people prefer to have a liquid dairy creamer, milk, cream or half and half, but do not have a refrigerator available close to the coffee maker. There is an need for a device that would take a minimum amount of space and provide conditions suitable to preserve dairy products. In the home, a coffee maker may be on a counter that is not directly adjacent to the refrigerator. In this case, a person must go through the following steps: 1. walk from the coffee maker to the refrigerator, 2. open the refrigerator door, 3. remove the creamer container, 4. close the refrigerator door, 5. carry the creamer back to the cup of coffee on the counter, 6. open the creamer container, 7. pour the creamer in the coffee, 8. close the creamer container, 9. carry the creamer back to the refrigerator, 10. open the refrigerator door, 11. place the creamer back into the refrigerator, and, 12. close the refrigerator door. A device that would keep creamer cold, which could be placed directly next to the coffee maker, and which could directly dispense the creamer, would eliminate 9 of the 12 steps recited, saving time, money, and aggravation.

Similar steps are needed to pour any beverage that is refrigerated, including soda pop, fruit or vegetable juice, etc., and this device would likewise save time, money, and aggravation in dispensing these beverages. Soda pop in the device could be poured by children without the need to open the refrigerator, or it could be left outside or wherever it could be plugged into an electrical outlet with household current. A small refrigerated device would also have use in refrigerating and storing any item normally stored in a refrigerator that is used at some distance from a refrigerator or that is left out of the refrigerator for a protracted length of time during its use.

U.S. Pat. No. 4,891,949 relates to a device for the storage and dispensing of diary creamers and other perishable items involving the use of thermoelectric cooling modules. The patent describes a removable container into which are placed a multitude of small coffee creamers. The removable container is refrigerated using thermoelectric. The device is designed specifically for dispensing individual creamers, wherein a person using this device removes an optional not fixedly attached shroud, and reaches into a vessel to remove creamers, which are then opened outside the device, are poured into a cup of coffee, and the small containers are discarded. In particular, a removable container means having an open end in which creamers are placed is claimed. The current invention, which will be described in detail, does not have a removable container into which creamers are placed, and would not be suitable for the purpose described in U.S. Pat. No. 4,891,949.

U.S. Pat. No. 5,042,258, Drinking Container, relates to an apparatus for storing and dispensing food products, and more particularly to one which can be used in vehicles such as cars, trucks, or boats. This patent claims a drinking container for use in a automotive vehicle, having a cup insert removably detachable from an insulating shell, the shell having a cylindrical side wall, and the drinking container facilitating the drinking directly therefrom, of a beverage. The current invention has no removable cup insert and does not facilitate the drinking of a beverage directly therefrom. In the current invention the beverage is poured from the device into a drinking cup or glass.

U.S. Pat. No. 5,060,479, Thermoelectric Device for Heating or Cooling Food and Drink Containers, relates to thermoelectric apparatus for heating or cooling food and drink containers in locations where conventional cooking and refrigerating apparatus are unavailable, e.g. in motor vehicles, offices, and hotel rooms, where standard household AC current is not available. The apparatus is for heating as well as cooling, for substantially cylindrical containers only. It has a heat transfer member of low heat storage capacity having a concave side facing a compartment structured to envelope part of a circumference of a container. A switch for selecting the direction of current flow, and means for tightening together a container and the heat transfer member are necessary elements of this heating or cooling device.

U.S. Pat. No. 4,274,262, Thermoelectric Jug Cooler and Control Circuit, relates to thermoelectric cooling devices for liquid containing vessels. The patent describes cooling liquid that is placed directly into the device, of which a container is a part, and it is not directed to a cooler for individual containers of liquid. It comprises holes in the supporting means, an elongated duct within the device, and first, second, and third circuit means for controlling temperatures. This Jug Cooler serves a different purpose and has different elements from the current invention.

U.S. Pat. No. 3,823,567, Thermoelectric-Vacuum Shipping Container, serves a different purpose than the current invention. It relates to a storage container that maintains a temperature within tight parameters and utilizes a vacuum insulated container and thermoelectric principles for controlling temperature. The current invention uses far fewer elements, and does not provide for reversing heat flow. The vacuum insulated space of the current invention is applied by itself and not in thermal series with a second insulating material and additional layer as in the subject shipping container. Eight distinct elements comprise the shipping container. The current invention requires fewer elements, and is not suited for a use as a shipping container. U.S. Pat. No. 3,823,567 is incorporated by reference.

U.S. Pat. No. 3,310,953, Portable Refrigerator for Beverage Containers and the Like, relates to a portable apparatus for refrigerating a beverage container, more particularly it relates to a close fitting receptacle for a multi-serving beverage container and a miniature refrigerating means, and is incorporated by reference. The casing in this device has low thermal conductivity. Also recited is a lower compartment enclosing a refrigerating unit. This device was designed to: 1. cool containers which are with drawn from the device and then opened and used; 2. to be portable; and 3. to hold discrete, individual servings. A stated objective of the device is that it is inexpensive to construct and manufacture. It will become apparent that the current invention is substantially lower in cost to manufacture, is higher in efficiency of operation, and occupies less space. The Portable Refrigerator has a heat dissipating unit which is under and on the interior of the device, which necessitates having inlet air and exhaust air means. The placement of the metal plate and heat sink in close proximity to and below the cold side of the thermoelectric unit decreases the overall efficiency of this device.

U.S. Pat. No. 2,991,628 relates to refrigerating apparatus particularly to portable thermoelectric apparatus for heating or cooling and is incorporated by reference. The current invention is not designed to be portable or to heat. Other differences in the current invention is that means for accomplishing certain functions are new, yielding economies in cost and efficiency.

U.S. Pat. No. 3,368,359 relates to a heat dissipating apparatus for a thermoelectric type water cooler and is incoporated by reference. Although the current invention is not a water cooler, the heat dissipation apparatus described may be useful in combination with the current invention. U.S. Pat. No. 4,320,626, by Donnelly, "Portable Beverage Chiller/Warmer" relates to a large picnic cooler of the type which has a large screw off top and a bottom spout to dispense the liquid. Donnelly's invention is a thermoelectric unit for heating or cooling a liquid in the container by having the thermoelectric unit in the screw off lid which has an element extending from the lid into the liquid. The instant invention is different in that it does not cool liquid, but a package of liquid, and also is not portable. Donnelly's device is not suitable to cool a package of liquid.

U.S. Pat. No. 5,301,508 by Kahl et al, "Thermoelectric Portable Container", describes a thermoelectric picnic basket in which the thermoelectric unit can be removed and positioned in different locations on the basket, and can be used in a heating or cooling mode. The present invention is not portable, has a fixed thermoelectric unit, and is not made for heating.

U.S. Pat. No. 2,947,150 by Roeder, Jr. "Refrigerating Apparatus Having Improved Heat Transferring Means" relates to a thermocouple panel in which the hot and cold junctions have their heat transferred to a remote area by means of a refrigerant. The present invention contemplates, in one embodiment, using heat pipe technology on the hot side only to increase heat dissipation.

U.S. Pat. No. 3,438,214 by Schmittle "Thermoelectric Temperature Control System" relates to an automatic control system for a thermoelectric temperature conditioning device having a thermostat which senses the temperature and control means to keep the temperature at a set point. The present invention has no thermostat to keep a pre set temperature.

U.S. Pat. No. 3,100,969 by T. M. Elfving, "Thermoelectric Refrigeration", shows thermoelectric modules in series with the facing surfaces of the 2 or more modules being thermally connected by hollow members filled with a fluid. The terminal heat absorbing and heat rejecting elements are also connected to the thermoelectric module by hollow members filled with a fluid. The amounts of fluid in each member must be balanced to obtain good heat transfer. The device is for use in refrigerators or freezers. Elfving teaches the use of two modules, with heat pipe type thermal contacts in between and on all sides of the thermoelectric module. The present invention, in one embodiment, uses a heat pipe to remove heat from the hot side only of a thermoelectric module. There is no reference in Elfring to a cooler for an individual package of liquid.

The following prior art U.S. Patents are less relevant to the present invention, but do describe some aspects of elements used in the current invention.

SUMMARY OF THE INVENTION

The objective of this device is to provide a small refrigerated apparatus for cooling, or keeping cool, a liquid contained within an individual package, bottle or container. Further objects are that the device is small; not much larger than the container to be kept cold, and that the device can be placed anywhere that household AC electricity is available. Additionally the device should be easy to dispense the liquid from with no need to remove the liquid package from the device. The device should be low in cost so that it may be easily purchased. The device should not be noisy so that it is not annoying in operation. The device should be easy to clean. These, and other objectives, have been met by this invention. The device is distinct from the prior art in the ways that have been recited in the prior art section, on a case by case basis. In addition, the device is unique because it is notably smaller than prior art devices because of its vacuum insulation, which allows for a smaller size. This insulation also allows for a smaller refrigeration unit which saves in both size and cost. The smaller heat load on the refrigeration unit allows the device to have a smaller and less expensive heat dissipation unit, saving both space and cost. In one embodiment the device uses no fan or motor to force convection in the heat dissipating unit, saving space and cost, and also eliminating all noise during operation.

Although the invention has many uses, it was originally conceived to provide a refrigerated container for coffee creamer which could be kept next to a coffee maker in the home or office. In the office, there are many times when a refrigerator to keep liquid creamer or milk is not available or accessible to the location of a coffee maker. In this case dry powdered "creamer" is normally used. I have found that the dry creamer is almost never preferred over a refrigerated creamer, primarily because of taste. A further disadvantage to powdered creamer is that it does not cool the coffee, and many people burn their tongues, at least occasionally. The use of this invention eliminates all these disadvantages. The device is an advantage even if a refrigerator is available because it is simpler to use with less steps to put creamer into coffee than to take the creamer out of a refrigerator, use it, and return it.

The invention is an insulated container which has a closable opening, is adapted to hold an individual package of creamer or other liquid, and is refrigerated. The refrigeration may be provided thermoelectrically, by the absorption process, by the compression-expansion process, or by other refrigeration processes. Thermoelectric refrigeration is the initially preferred type of refrigeration because of its small size and simplicity of operation. Two additional components, vacuum insulation and a high surface area heat dissipating unit, serve to make the device have a low refrigeration demand and to make it lower in cost and quiet in operation. Additional optional features will become apparent by examining the drawings and descriptions.

DETAILED DESCRIPTION

Figure 1:
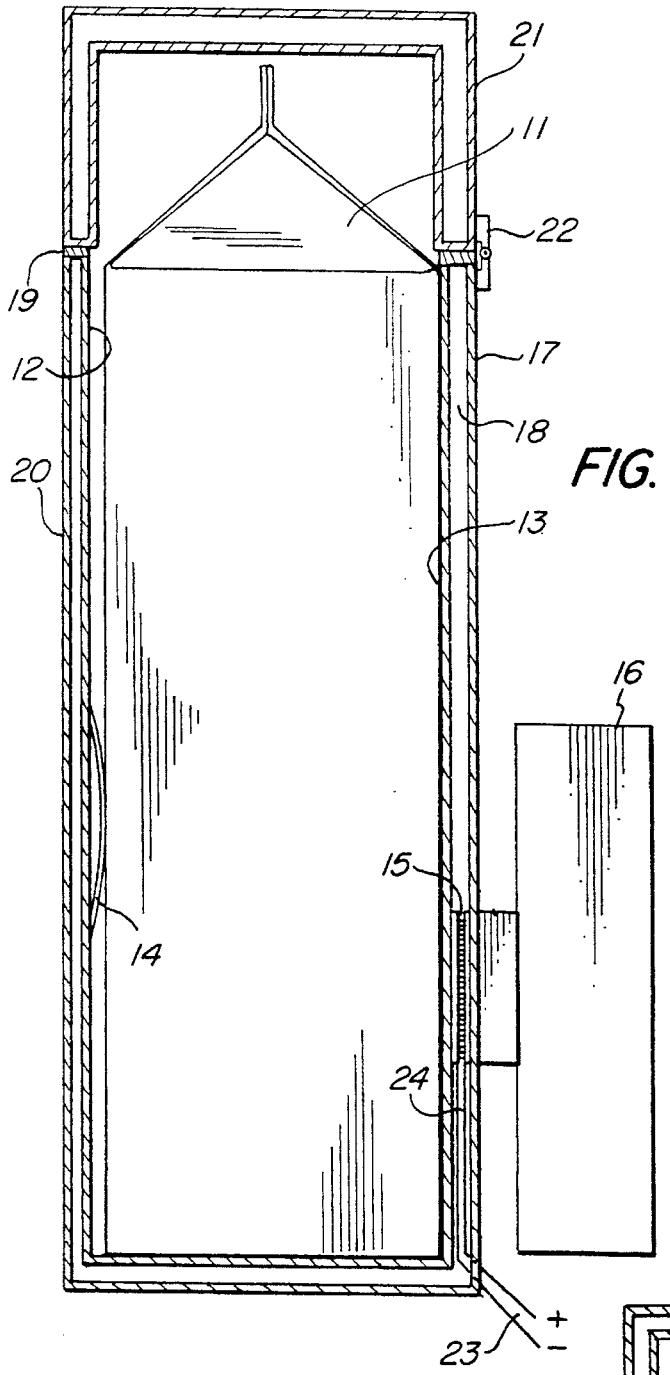
FIG. 1 is a drawing of the device in side view, showing the elements of the device.

In the following detailed description and in the several figures of the drawings, like elements are identified with like reference numerals.

Referring now to FIG. 1, a side view, it shows a liquid cooling device for cooling a liquid package 11. The liquid package 11 is urged against the inner shell 12 in the area of the cooled wall 13 by a spring 14 which may be either a metal band as shown, a piece of compressible plastic foam, or other means that urges the container toward the cooled wall 13 of the inner shell 12, including simply a tight fit. Keeping the liquid package 11 in close contact with the cooled wall 13 aids in transferring heat out of the liquid package to a cooling unit 15, shown in FIG. 1 as a thermoelectric module. A heat extracting portion, or cold side, of the cooling unit 15 contacts the cooled wall 13, so that the cold side of the cooling unit is in thermal contact with the liquid package 11. A hot side of the cooling unit 15 contacts a heat dissipation unit 16. The heat dissipation unit 16 dissipates the heat into the surrounding air by convection, and is preferably colored black for additional heat dissipation by radiation. The inner shell 12 is surrounded by an outer shell 17 and a vacuum 18 exists between the inner and outer shells 12 and 17. The facing sides of the inner and outer shells 12 and 17 are silvered. The shells 12 and 17 are joined together at the top 19 of the bottom portion 20 of the container 10. The inner and outer shells, 12 and 17, are joined to each other such that a minimum amount of one shell touches the other, similar to a stainless steel vacuum bottle, to minimize heat transfer from one shell to the other. The top portion 21 of the coding device is similarly constructed with inner and outer shells, silvered facing surfaces, a vacuum in-between shells, and are joined with a minimum area. The top portion 21 is attached to the bottom portion 20 with a hinge 22. The cooling device 15 is supplied with electric current 23 through wires 24. A handle is attached to the bottom portion 20 to aid in pouring liquid from the container 11 that is within the cooling device.

In operation heat is extracted from the liquid through the package 11 surface by the cooled wall 13 which is cooled by the cooling module 15. Heat is pumped from the cooling module 15 to the heat dissipating unit 16 which dissipates the heat to the surroundings, thus cooling the package 11. The vacuum bottle insulation of the device allows very little heat to enter the package 11 from the surroundings. To pour liquid from the device, the top portion 21 is flipped back using a hinge 22 which is attached to a bottom portion 20 and a top portion 21. A handle is then used to lift the device and pour the liquid from the package 11.

Figure 2:
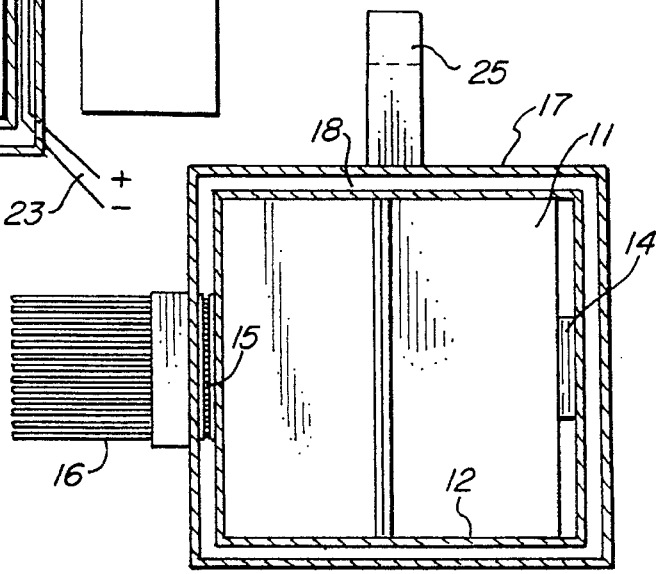
FIG. 2 is a drawing of the top view showing elements of the device.

FIG. 2 is a top view of the device, in which it is easier to view some of the components, for example the handle 25.

Figure 3:
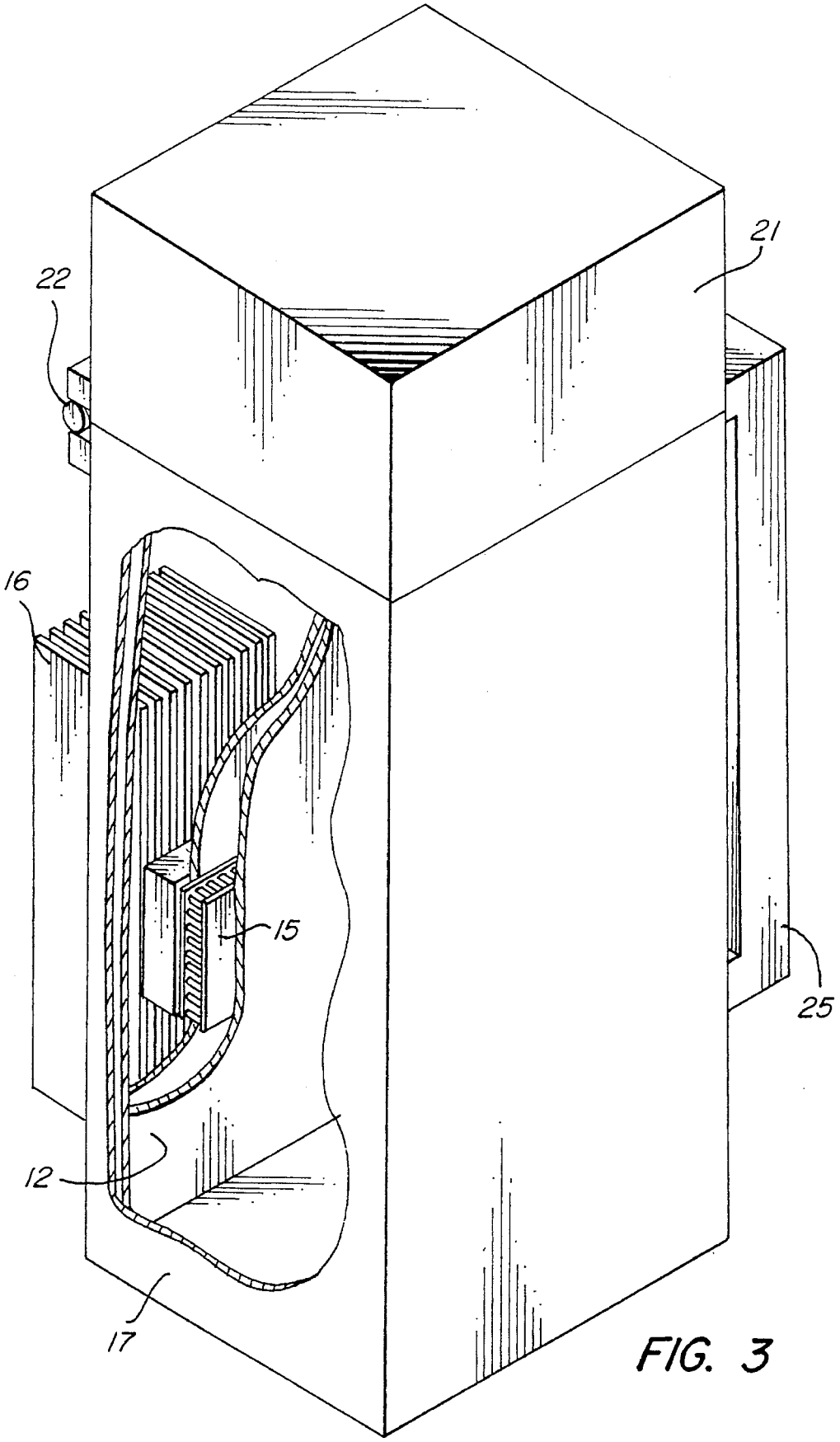
FIG. 3 is a drawing showing a perspective view of the device.

FIG. 3 is a prospective view of the device, which better shows the handle 25.

Figure 4:
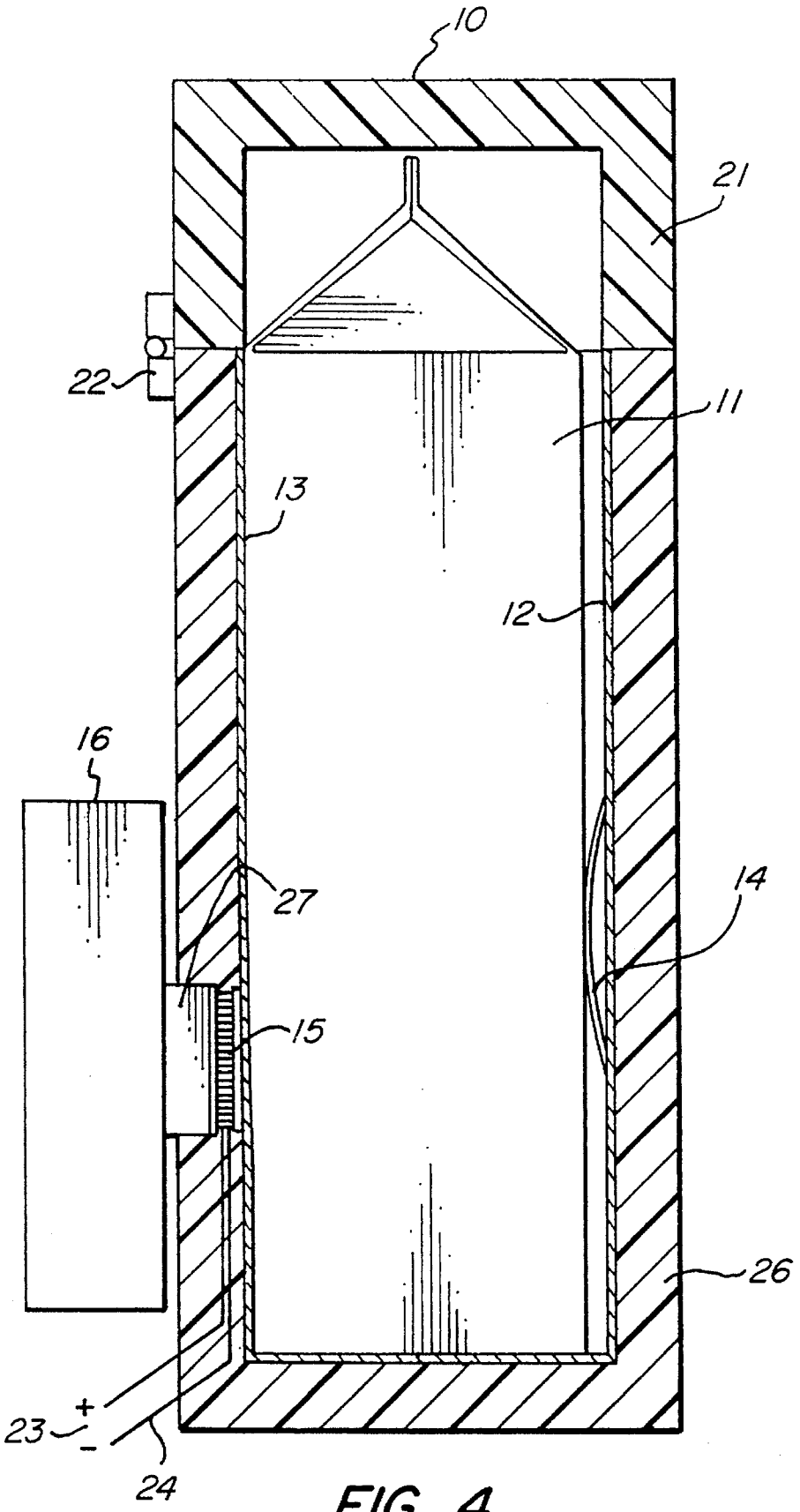
FIG. 4 is similar to FIG. 1 but shows the device with foam insulation.

FIG. 4 is an alternate embodiment which shows the cooling device 10 using foam insulation 26. A heat conducting block 27 is used to connect the cooling module with the heat exchanger.

Figure 5:
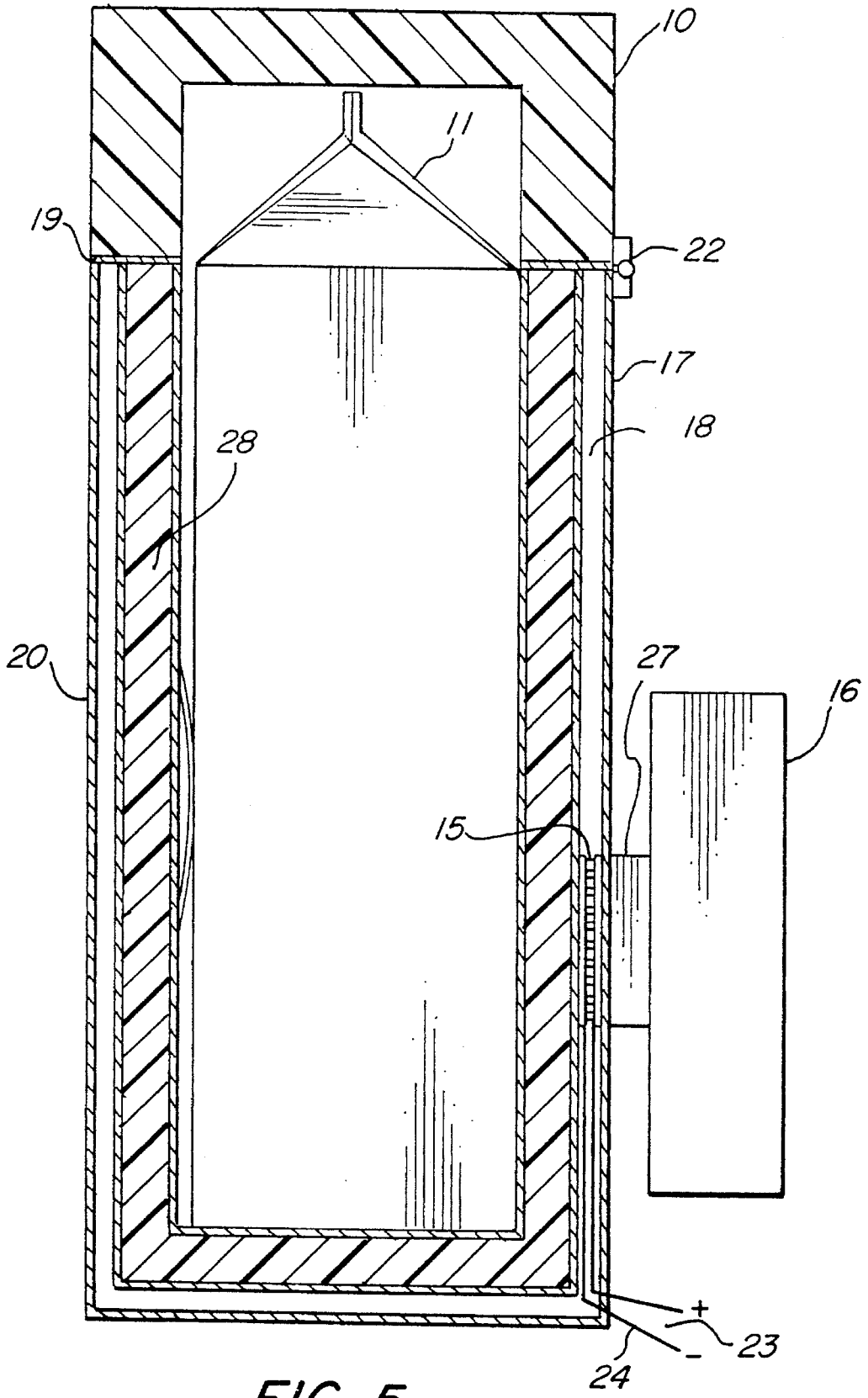
FIG. 5 is similar to FIG. 1 but shows a thickened inner "cold sink" casing.

FIG. 5 shows the device 10 with a filled inner casing 28 in the lower portion 20. The casing shell may be filled with a solid or a liquid, preferably the fill material has high BTU per degree per pound. The purpose of the "cold sink" or cold reservoir is to provide a cold mass on the interior of the device so that a package placed within the device will cool more quickly. With a cold sink a smaller more economical refrigeration unit may be used and the device will still have a quick cooling capacity.

Figure 6:
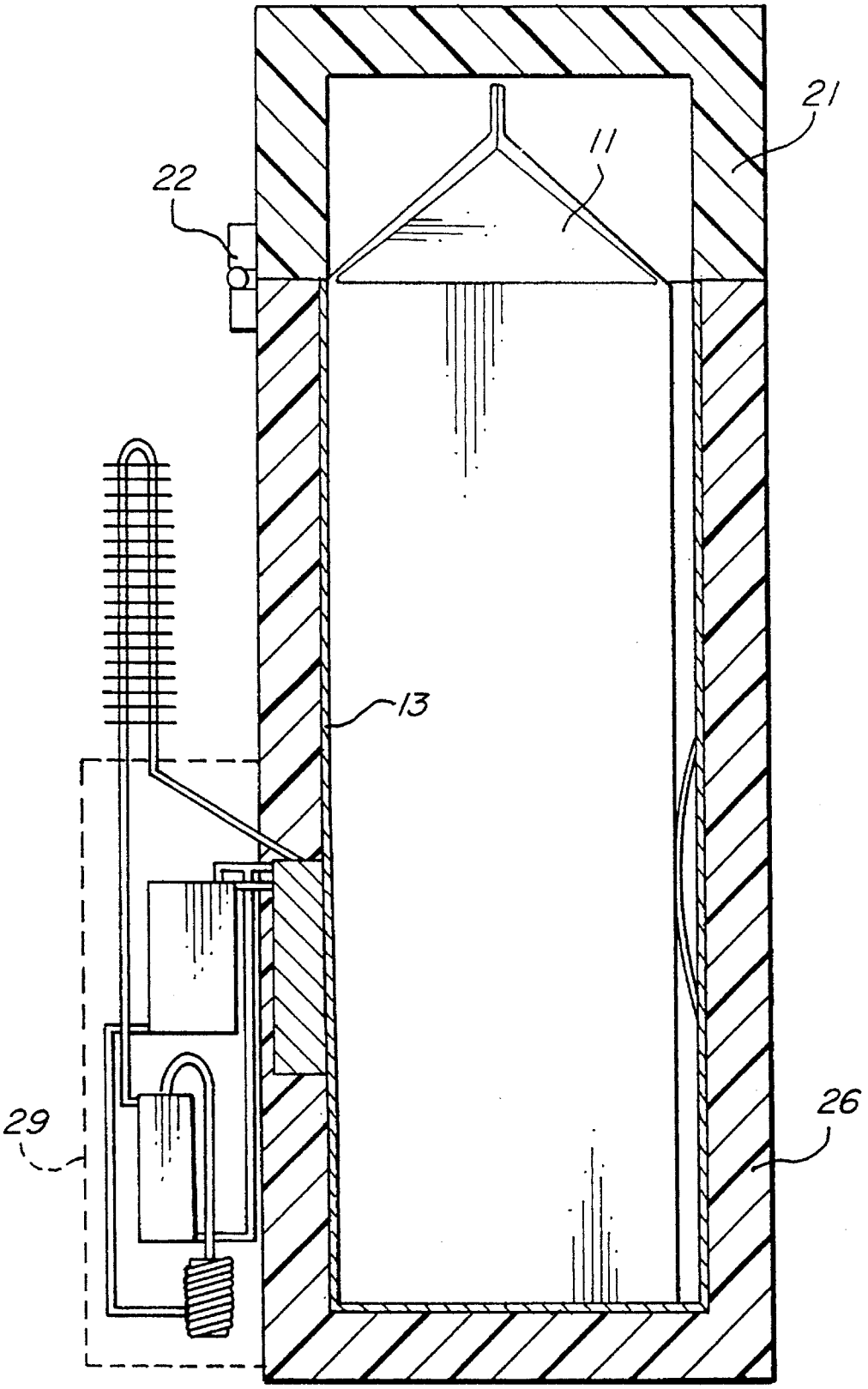
FIG. 6 is similar to FIG. 4 but shows an absorption refrigeration unit.

FIG. 6 shows the device with an absorption refrigeration unit 29.

Figure 7:
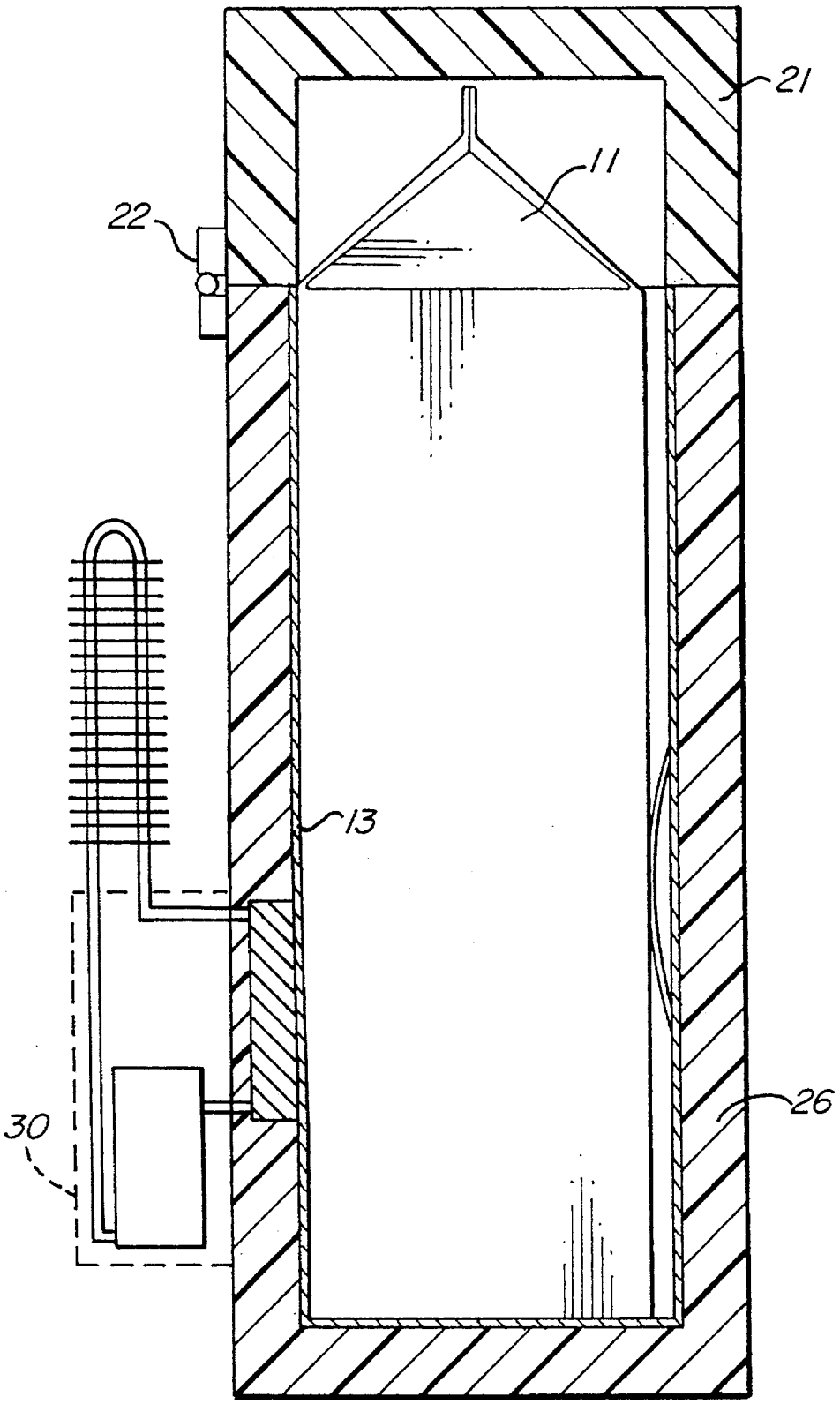
FIG. 7 is similar to FIG. 4 but shows a compression-expansion refrigeration unit.

FIG. 7 shows the device with a compression refrigeration unit 30.

Figure 8:
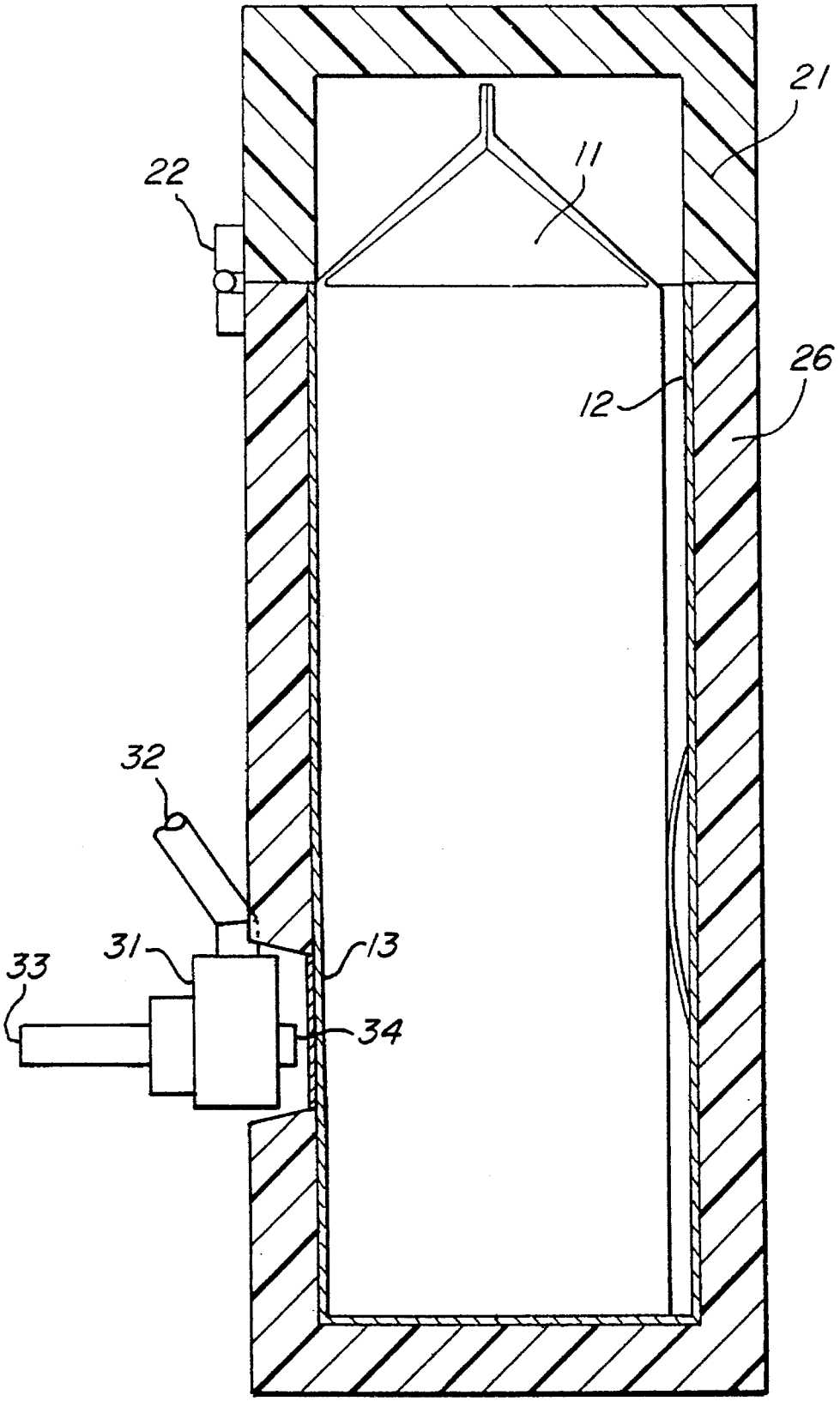
FIG. 8 is similar to FIG. 4 but shows a vortex cooling refrigeration unit.

FIG. 8 shows the device with a vortex tube cooling unit 31. The vortex tube is supplied with pressurized air 32, and it separates the air into a hot fraction 33 and a cold fraction 34. The cold fraction cools the cooled wall 13 which in turn cools the liquid package 11.

Figure 9:
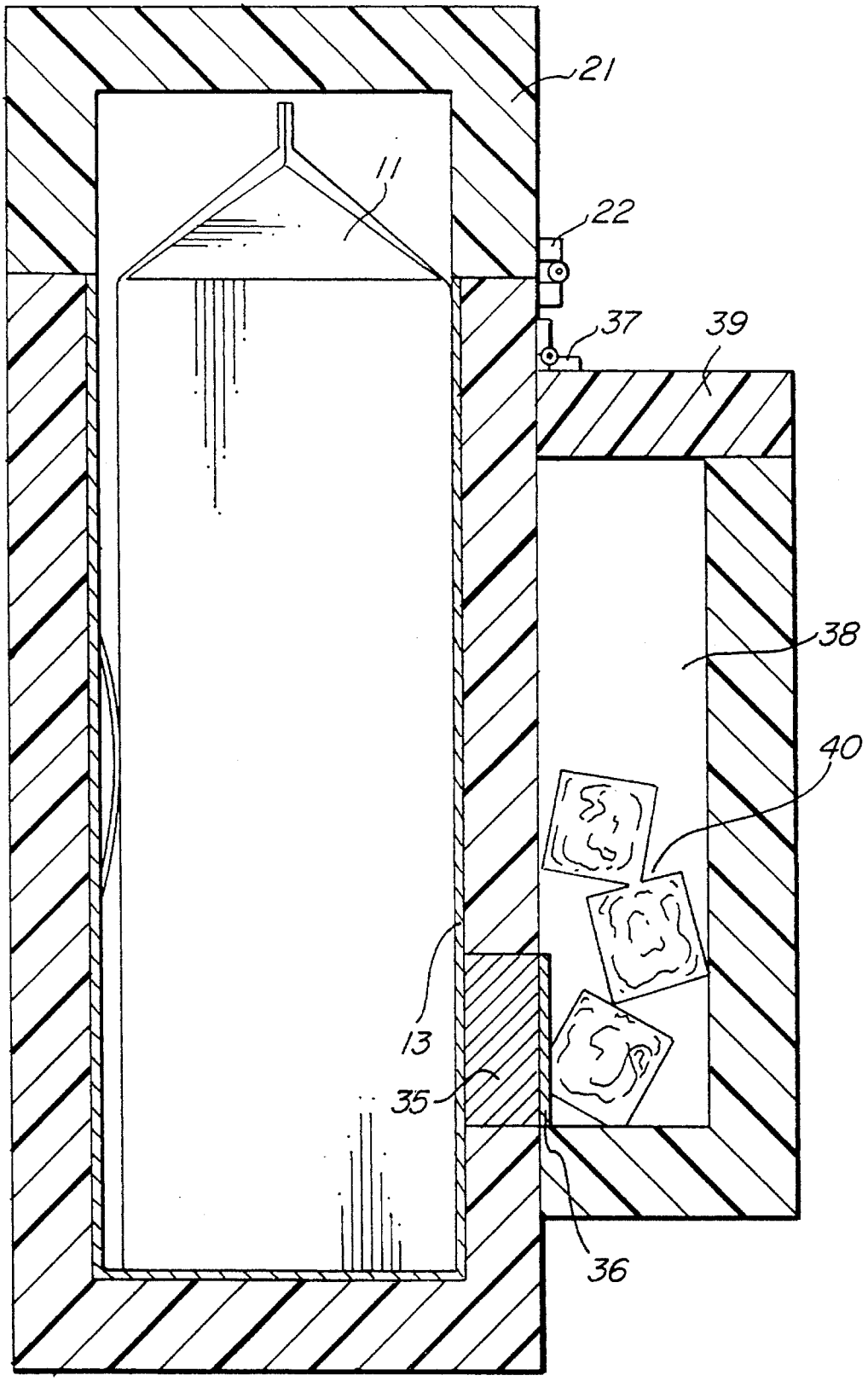
FIG. 9 is similar to FIG. 4 but shows cooling provided by a consumable refrigerant such as ice.

FIG. 9 shows the device arranged so that a consumable coolant, for example: water, ice and/or dry ice, can be used to provide refrigeration. Although shown with foam insulation, vacuum bottle insulation is preferable. In this figure an insulated consumable coolant reservoir 38 is attached to the outer surface of the device and is provided with an insulated lid 39 attached by a reservoir hinge 37. Heat is extracted from the cooled wall 13 by a heat conductive member 35. Heat is extracted from the heat conductive member 35 by a thermal choke 36, which is in contact with and cooled by the consumable coolant 40. The thermal choke 36 allows for adjustment of how much thermal conduction there is between the consumable coolant 40 and the heat conduction block 35. The thermal choke 36 may be a plate with suitable thermal conduction properties to meter the cooling over an extended period of time. The coolant reservoir 38 may be used as the handle.

Figure 10:
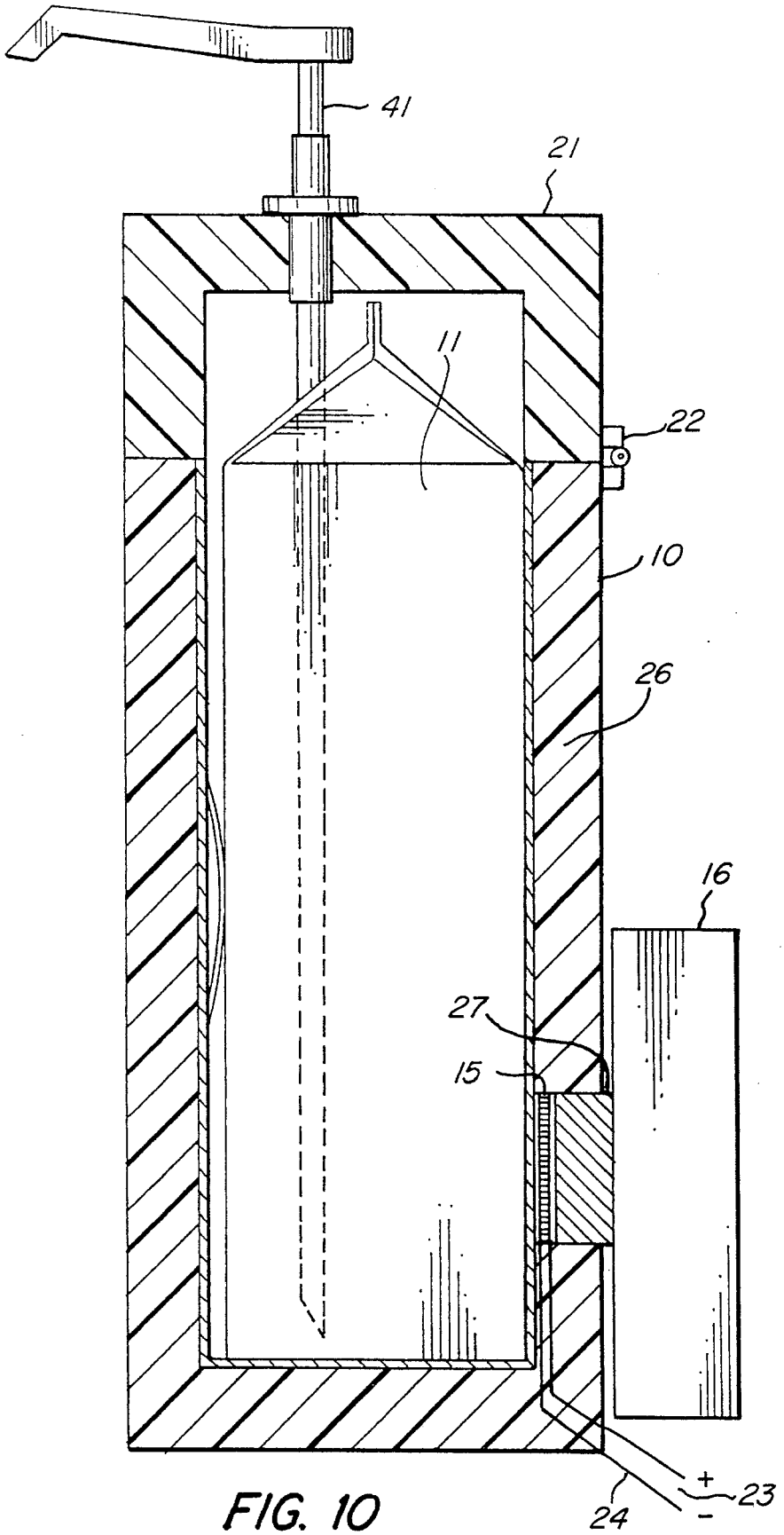
FIG. 10 is similar to FIG. 4 and shows a dispensing pump.

FIG. 10 shows the device 10 using a pump 41 to dispense the liquid within the package 11.

The basic device or invention is a liquid cooling device made up of a container for holding a liquid which has thermal insulation and a closable opening, and a refrigerating unit which is in thermal contact with the liquid in the container resulting in cooling of the liquid in the container. The closable opening provides access for loading and dispensing the liquid.

In one variation of the basic device the liquid is contained within a package, and the container is adapted to receive and hold the package in a close fitting relationship, so that there is good thermal contact between the refrigerating unit and the package containing the liquid.

The basic device is small in size. The liquid contained is no more than about one gallon.

In a thermoelectric embodiment of the basic device the refrigerating unit is made up of, in part a thermoelectric module.

The basic device may have a fan unit to increase the rate of heat dissipation from a heat dissipating unit of the refrigerating unit.

The basic device may have a spring to urge a liquid package in the container into thermal contact with the cooling portion of the refrigerating unit, and this thermal contact may be through an inner wall or an inner shell of the container.

The basic device's closable opening may be a thermally insulated top portion of the container attached to a thermally insulated bottom portion of the container by a hinge. This allows for the opening of the container to load and dispense or pour a liquid out of the container.

The basic device may have a handle to facilitate easy pouring of the liquid in the container.

The basic device may have thermal insulation which is of a vacuum bottle type. In this type insulation a vacuum exists in a space between two facing surfaces, the facing surfaces having a low thermal emissivity, and the facing surfaces being joined to each other and forming an enclosure into which a liquid package may be placed.

The basic device may have thermal insulation which is a foamed material. This can be either a polymeric foamed material, a glass foamed material, or any other foamed material useful as thermal insulation.

The thermoelectric embodiment of the device the refrigerating unit may include a heat dissipating unit having fins, the fins having a surface area greater than forty square inches and the fins being less than 0.30 inch thick.

In the thermoelectric embodiment of the device the thermoelectric module has a hot side. This hot side may be in intermittent thermal contact with a heat dissipating unit. A thermoelectric module supply current is stopped and at the same time thermal contact is broken. This allows the heat dissipating unit to cool. When cooled the thermal contact and the supply current is re-established. This allows for lower temperature refrigeration of the liquid, particularly when no means to force convection in the heat dissipating unit is used.

Also in the thermoelectric embodiment of the device the thermoelectric module may be intermittently supplied with a lower voltage. This also allows a heat dissipating unit to lower in temperature before re-applying a higher voltage, and also allows for lower temperature refrigeration.

The basic device may include a cold sink. This includes a casing filled with a substance, or the casing is solid. The casing may be a plate of metal. The thermal mass of the cold sink, in BTU, should be equal to or greater than an amount needed to cool a mass of a full liquid package at least 8 degrees Fahrenheit, when the liquid package full of water in thermal contact with the cold sink are considered as an adiabatic system, the cold sink being at a temperature of no less than 30 degrees Fahrenheit and the full liquid package being at a temperature of no more than 70° F.

In the thermoelectric embodiment of the device the heat dissipating unit may include a block of material having a high thermal conductivity which has cored internal passages and is in thermal contact with a hot side of the thermoelectric module. The heat dissipating unit additionally has tubes connected and sealed to said passages. The tubes rise from the passages away from the block, and have a liquid vapor phase fluid sealed in the block and tubes, and the tubes dissipate heat to the air.

The basic device may have as the refrigerating unit any type of refrigeration including, an absorption refrigeration apparatus, A compression—expansion refrigeration apparatus, a vortex tube refrigeration apparatus, or an ice refrigeration apparatus.

The basic device may include a dispensing pump inserted through the container and into a liquid for dispensing the liquid without having to open the container.

A second embodiment of the liquid cooling device includes a container sized to accept a single package of a dairy product. The containers exterior surface is insulated from its interior surface, the insulation being of the vacuum bottle type. The container has a top portion attached to a bottom portion with a hinge and a thermoelectric module with a hot side and a cold side when a direct current is applied to the thermoelectric module. The cold side is in thermal contact with the cold sink, and the hot side is in thermal contact with a heat dissipating unit. The heat dissipating unit has a surface area of greater than forty square inches. The direct current required by the thermoelectric module is converted from household alternating current, allowing the liquid cooling device to be plugged in to a standard household electrical outlet. The thermoelectric module cold side extracts heat from the package of liquid through the inner shell and the thermoelectric module hot side pumps heat to the heat dissipating unit which dissipates the heat into a surrounding atmosphere, causing the package of liquid to be cooled.

A third embodiment of a liquid cooling device is made up of a container having foamed material thermal insulation on an outer surface, an inner shell, and a closeable opening. The container is sized to accept a single package of liquid in a close fitting relationship. A thermoelectric refrigerating unit further includes a heat dissipating unit having fins and a fan unit to increase convective heat loss from the heat dissipating unit on a hot side of a thermoelectric module.A cold side of the thermoelectric module is in thermal contact with the inner shell. The thermoelectric refrigerating unit is capable of maintaining a temperature of the inner shell at least thirty degrees Fahrenheit below the ambient temperature outside the container.

Alternately the basic liquid cooling device may be described as a thermally insulated container with means for suppling cooling to an interior of the thermally insulated container, the interior adapted to receive and contain a single package of liquid in a thermally contacting relationship with the means for supplying cooling This relationship makes and keeps the package of liquid cool.

Each of the features shown in the figures may be used in combination with features shown in any other drawing and remain within the scope of this invention. Other methods of accomplishing the functions of various elements are known in the respective arts of insulation, refrigeration, and cold storage and may be substituted for the specific elements shown, and still be within the scope of this disclosure.

I claim:

1. A cooling device for a package of liquid comprising:

(a) a container for holding a single package of liquid, said container adapted to receive and hold said single package in a close fitting relationship, said container having thermal insulation and a closable opening, and (b) a refrigerating unit, said refrigerating unit having a cooling portion, said cooling portion in thermal contact with the liquid, wherein the cooling portion provides cooling for the liquid in the package in the container, wherein the liquid within the package is no more than about one gallon, the closable opening further comprising a thermally insulated top portion of the container attached to a thermally insulated bottom portion of the container, allowing for easy opening of the container to load, dispense or pour the liquid out of the package.

2. The liquid cooling device of claim 1 wherein the refrigerating unit comprises a thermoelectric module.

3. The device of claim 1 further comprising a fan unit to increase the rate of heat dissipation from a heat dissipating unit of the refrigerating unit.

4. The device of claim 1 further comprising a spring to urge a liquid package in the container into thermal contact with the cooling portion of the refrigerating unit.

5. The device of claim 1 further comprising a handle to facilitate easy pouring of the liquid in the container.

6. The device of claim 1 wherein said thermal insulation is of a vacuum bottle type, in which a vacuum exists in a space between two facing surfaces, said facing surfaces having a low thermal emissivity.

7. The device of claim 2 wherein the refrigerating unit further comprises a heat dissipating unit having fins, said fins having a surface area greater than forty square inches, and said fins being less than 0.30 inch thick.

8. The device of claim 2 wherein the thermoelectric module has a hot side, said hot side being in intermittent thermal contact with a heat dissipating unit, such that a thermoelectric module supply current is stopped when the thermal contact is broken, thus allowing the heat dissipating unit to cool, and when cooled the thermal contact and the supply current is re-established, allowing for lower temperature refrigeration of the liquid.

9. The device of claim 2 wherein the thermoelectric module is intermittently supplied with a lower voltage allowing a heat dissipating unit to lower in temperature before re-applying a higher voltage, allowing for lower temperature refrigeration, wherein neither the lower voltage value or the duration of its application is controlled by the temperature of the item being cooled, the temperature of the thermoelectric module, the ambient temperature or any combination of these temperatures.

10. The device of claim 2 further comprising a cold sink wherein a casing is filled with a substance, a thermal mass of the cold sink, in BTU, which is equal to or greater than an amount needed to cool a mass of a full liquid package at least 8 degrees Fahrenheit, when the liquid package full of water in thermal contact with the cold sink are considered as an adiabatic system, the cold sink being at a temperature of no less than 30 degrees Fahrenheit and the full liquid package being at a temperature of no more than 70° F.

11. The device of claim 1 wherein the heat dissipating unit comprises a block of material having a high thermal conductivity which has cored internal passages and is in thermal contact with a hot side of the thermoelectric module, said heat dissipating unit additionally has tubes sealably connected to said passages, and rising from said passages away from the block, with a liquid vapor phase fluid sealed in said block and tubes, and the tubes dissipating heat to the air.

12. The device of claim 1 further comprising a dispensing pump inserted through the container and into the liquid for dispensing the liquid without having to open the container.

13. A liquid cooling device comprising a container sized to accept a single package of a liquid food product, said container having an interior surface and an exterior surface, with vacuum bottle type thermal insulation in-between the surfaces, said container having an inner shell, the container further comprising a top portion attached to a bottom portion said top portion being movable with respect to said bottom portion and functioning as a closable opening, a thermoelectric module with a hot side and a cold side when a direct electrical current is applied to the thermoelectric module, said cold side in thermal contact through solid materials with the package, and said hot side in thermal contact with a heat dissipating unit, said heat dissipating unit having a surface area of greater than forty square inches, and wherein the direct electrical current is converted from a household alternating electrical current allowing the liquid cooling device to be plugged in to a standard household electrical outlet, wherein the thermoelectric module cold side extracts heat from the package of liquid through the inner shell and the thermoelectric module hot side pumps heat to the heat dissipating unit which dissipates the heat into a surrounding atmosphere.

14. A liquid cooling device comprising a container having thermal insulation on a outer surface, an inner shell, and a closeable opening, said container sized to accept a single package of liquid in a close fitting relationship, a thermoelectric refrigerating unit further comprising a heat dissipating unit having fins and a fan unit to increase convective heat loss from the heat dissipating unit on a hot side of a thermoelectric module, a cold side of the thermoelectric module in thermal contact with the inner shell, said thermoelectric refrigerating unit being capable of maintaining a temperature of the inner shell at least thirty degrees Fahrenheit below an ambient temperature outside the container.

* * * * *